US009880509B2

(12) United States Patent
Shoji et al.

(10) Patent No.: US 9,880,509 B2
(45) Date of Patent: Jan. 30, 2018

(54) IMAGE FORMING APPARATUS, IMAGE FORMING UNIT, CLEANING CONTROL METHOD

(71) Applicant: KYOCERA Document Solutions Inc., Osaka-shi, Osaka (JP)

(72) Inventors: Haruki Shoji, Osaka (JP); Okito Ogasahara, Osaka (JP); Naohiro Anan, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/166,128

(22) Filed: May 26, 2016

(65) Prior Publication Data

US 2016/0349694 A1 Dec. 1, 2016

(30) Foreign Application Priority Data

May 29, 2015 (JP) ..... 2015-110675

(51) Int. Cl.

| | |
|---|---|
| ***G03G 21/00*** | (2006.01) |
| ***G03G 15/00*** | (2006.01) |
| *G03G 15/20* | (2006.01) |
| *G03G 21/14* | (2006.01) |

(52) U.S. Cl.

CPC ..... *G03G 21/0005* (2013.01); *G03G 15/55* (2013.01); *G03G 15/20* (2013.01); *G03G 21/145* (2013.01)

(58) Field of Classification Search

CPC ..... G03G 21/00; G03G 15/50; G03G 15/161; G03G 21/0005

See application file for complete search history.

(56) References Cited

U.S. PATENT DOCUMENTS 5,508,784 A * 4/1996 Matsuoka ..... G03G 15/01 399/130

FOREIGN PATENT DOCUMENTS

| | | | |
|---|---|---|---|
| JP | S55100490 | U | 7/1980 |
| JP | H04107580 | A | 4/1992 |
| JP | H11352852 | A | 12/1999 |
| JP | 2000047545 | A | 2/2000 |
| JP | 2007108252 | A | 4/2007 |
| JP | 2009265229 | A | 11/2009 |
| JP | 2010124925 | A | 6/2010 |
| JP | 2014002202 | A | 1/2014 |

* cited by examiner

*Primary Examiner* — David M Gray
*Assistant Examiner* — Andrew V Do
(74) *Attorney, Agent, or Firm* — Alleman Hall Creasman & Tuttle LLP

(57) ABSTRACT

An image forming apparatus includes an image carrier, a motor, a cleaning portion, a measurement processing portion, and a cleaning control portion. The image carrier is configured to carry an electrostatic latent image. The motor is configured to rotate the image carrier. The cleaning portion is configured to clean the image carrier. The measurement processing portion is configured to measure a transition time that is a time required for the motor to transition from a stationary state to a driving state in which the motor rotates at a predetermined speed. The cleaning control portion is configured to control a cleaning time of the cleaning portion or whether or not to cause the cleaning portion to clean the image carrier.

4 Claims, 6 Drawing Sheets

IMAGE FORMING APPARATUS, IMAGE FORMING UNIT, CLEANING CONTROL METHOD

INCORPORATION BY REFERENCE

This application is based upon and claims the benefit of priority from the corresponding Japanese Patent Application No. 2015-110675 filed on May 29, 2015, the entire contents of which are incorporated herein by reference.

BACKGROUND

The present disclosure relates to an image forming apparatus, an image forming unit mounted in an image forming apparatus, and a cleaning control method.

In an image forming apparatus such as a printer for forming an image by the electrophotography, a charging device charges the surface of an image carrier such as a photoconductor drum, and an electrostatic latent image is formed on the surface of the image carrier. This type of image forming apparatus may include a cleaning portion such as a cleaning blade for cleaning toner and foreign substances such as discharge products that have been adhered to the surface of the image carrier. In addition, there is known a configuration for detecting a load of a motor that rotates the image carrier, based on an electric current that flows through the motor.

SUMMARY

An image forming apparatus according to an aspect of the present disclosure includes an image carrier, a motor, a cleaning portion, a measurement processing portion, and a cleaning control portion. The image carrier is configured to carry an electrostatic latent image. The motor is configured to rotate the image carrier. The cleaning portion is configured to clean the image carrier. The measurement processing portion is configured to measure a transition time that is a time required for the motor to transition from a stationary state to a driving state in which the motor rotates at a predetermined speed. The cleaning control portion is configured to control a cleaning time of the cleaning portion or whether or not to cause the cleaning portion to clean the image carrier.

An image forming unit according to another aspect of the present disclosure includes an image carrier, a motor, a cleaning portion, a measurement processing portion, and a cleaning control portion. The image carrier is configured to carry an electrostatic latent image. The motor is configured to rotate the image carrier. The cleaning portion is configured to clean the image carrier. The measurement processing portion is configured to measure a transition time that is a time required for the motor to transition from a stationary state to a driving state in which the motor rotates at a predetermined speed. The cleaning control portion is configured to control a cleaning time of the cleaning portion or whether or not to cause the cleaning portion to clean the image carrier.

A cleaning control method according to a further aspect of the present disclosure is executed in an image forming apparatus that includes an image carrier configured to carry an electrostatic latent image, a motor configured to rotate the image carrier, and a cleaning portion configured to clean the image carrier. The cleaning control method includes a first step and a second step. In the first step, a transition time that is a time required for the motor to transition from a stationary state to a driving state in which the motor rotates at a predetermined speed, is measured. In the second step, a cleaning time of the cleaning portion or whether or not to cause the cleaning portion to clean the image carrier is controlled.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the attached drawings. It should be noted that the following embodiments are an example of specific embodiments of the present disclosure and should not limit the technical scope of the present disclosure.

First Embodiment

First, an outlined configuration of an image forming apparatus 10 according to a first embodiment of the present disclosure is described with reference to FIG. 1 and FIG. 2. Here, FIG. 1 is a schematic cross-sectional view showing the configuration of the image forming apparatus 10.

Figure 1:
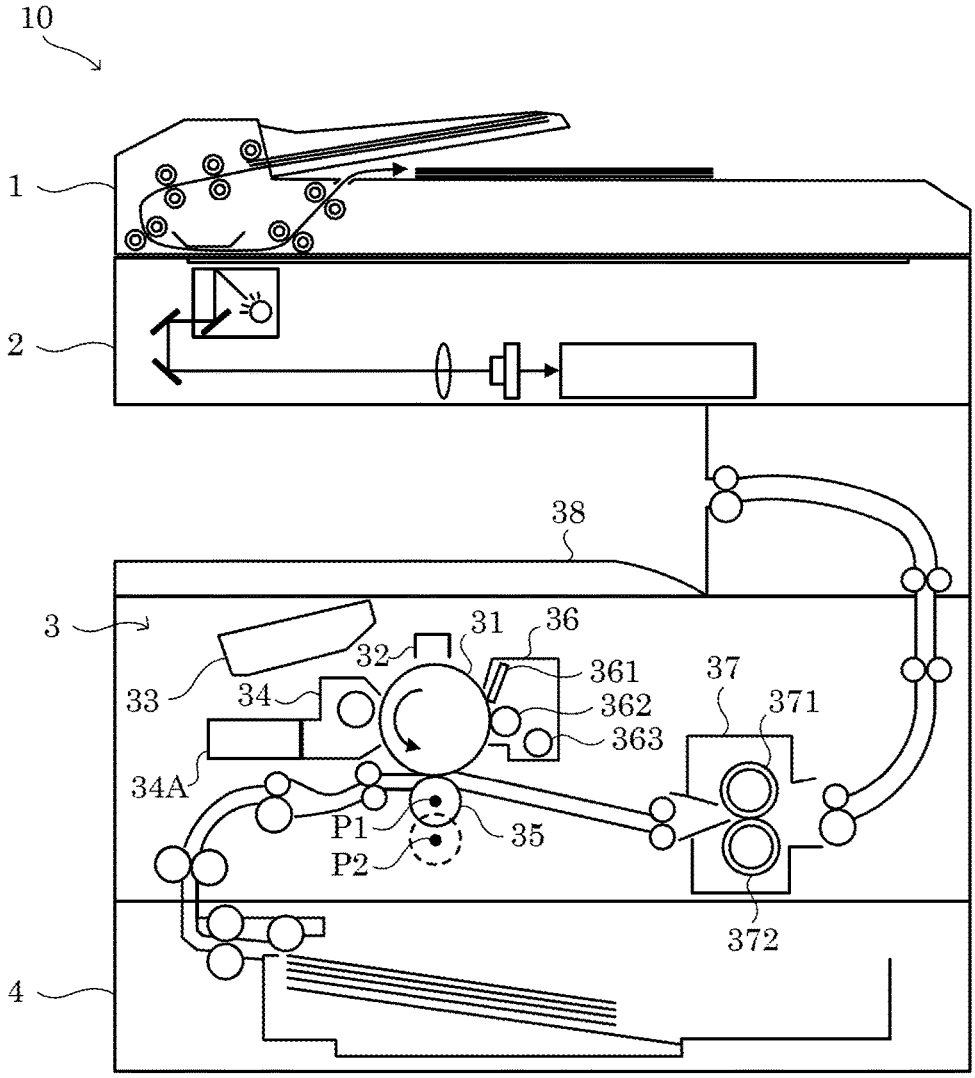
FIG. 1 is a diagram showing the configuration of an image forming apparatus according to a first embodiment of the present disclosure.
Figure 2:
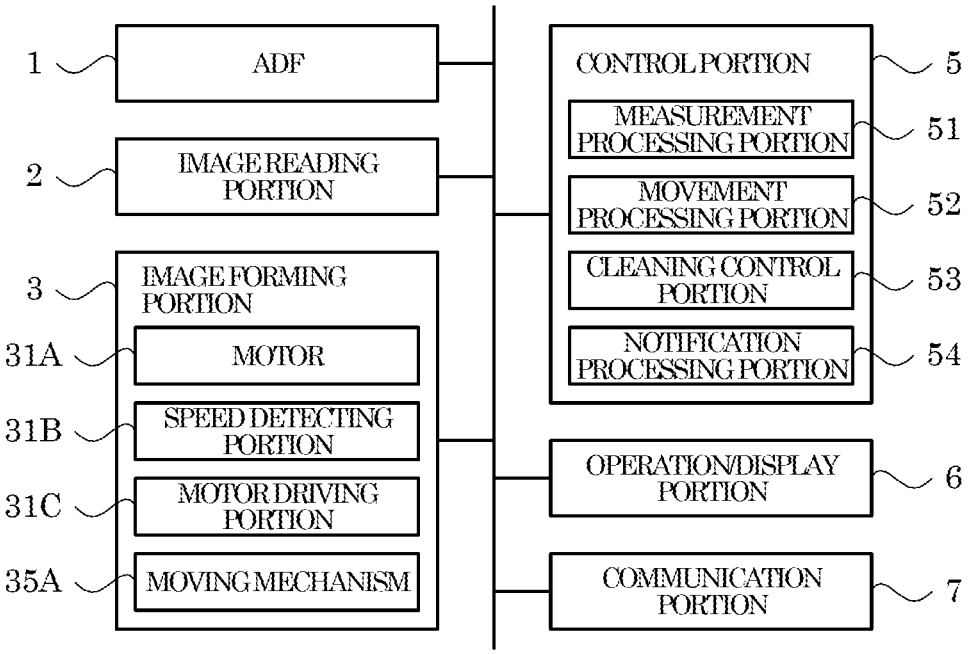
FIG. 2 is a block diagram showing the system configuration of the image forming apparatus according to the first embodiment of the present disclosure.

As shown in FIG. 1 and FIG. 2, the image forming apparatus 10 includes an ADF 1, an image reading portion 2, an image forming portion 3, a sheet feed portion 4, a control portion 5, an operation/display portion 6, and a communication portion 7. The image forming apparatus 10 is a multifunction peripheral having a plurality of functions such as a scan function for reading image data from a document sheet, a print function for forming an image based on the image data, a facsimile function, or a copy function. In addition, the present disclosure is applicable to an image forming apparatus such as a printer device, a facsimile device, or a copier.

The ADF 1 includes a document sheet setting portion, a plurality of conveyance rollers, a document sheet pressing, and a sheet discharge portion, and is an automatic document feeder for feeding a document sheet to be read by the image reading portion 2. The image reading portion 2 includes a document sheet table, a light source, a plurality of mirrors, an optical lens, and a CCD (Charge Coupled Device), and is configured to read image data from a document sheet.

The control portion 5 includes CPU, ROM, RAM, and EEPROM™ that are not shown. The CPU is a processor that executes various calculation processes. The ROM is a nonvolatile storage portion in which various information such as control programs for causing the CPU to execute various processes are stored in advance. The RAM is a volatile storage portion, and is used as a temporary storage memory (working area) for the various processes executed by the CPU. The EEPROM is a nonvolatile storage portion. In the control portion 5, the CPU executes the various control programs stored in advance in the ROM. This allows the image forming apparatus 10 to be controlled comprehensively by the control portion 5. It is noted that the control portion 5 may be formed as an electronic circuit such as an integrated circuit (ASIC), and may be a control portion provided independently of a main control portion that comprehensively controls the image forming apparatus 10.

The operation/display portion 6 includes a display portion and an operation portion. The display portion is, for example, a liquid crystal display and displays various types of information based on control instructions from the control portion 5. The operation portion is composed of, for example, operation keys or a touch panel through which various types of information are input to the control portion 5 based on user operations.

The communication portion 7 is a communication interface that can perform a wired or wireless data communication with an external communication apparatus.

The image forming portion 3 is configured to execute an image forming process (print process) of forming an image by the electrophotography based on image data read by the image reading portion 2 or image data input from an external information processing apparatus such as a personal computer.

Specifically, as shown in FIG. 1, the image forming portion 3 includes a photoconductor drum 31, a charging device 32, an optical scanning device 33, a developing device 34, a transfer portion 35, a cleaning portion 36, a fixing device 37, and a sheet discharge tray 38.

The photoconductor drum 31 carries an electrostatic latent image. As one example, the photoconductor drum 31 has a photoconductor layer made of amorphous silicon. The photoconductor drum 31 is rotated counterclockwise as indicated by the arrow of FIG. 1 by a driving force supplied from a motor 31A (see FIG. 2). Here, the photoconductor drum 31 is an example of the image carrier of the present disclosure.

The charging device 32 charges the surface (photoconductor layer) of the photoconductor drum 31. As one example, as shown in FIG. 1, the charging device 32 is disposed to be separated from the photoconductor drum 31. A voltage is applied to the charging device 32 from a power supply device (not illustrated). This causes a discharge between the charging device 32 and the photoconductor drum 31, thereby the surface of the photoconductor drum 31 is charged.

The optical scanning device 33 forms an electrostatic latent image on the surface of the photoconductor drum 31 by irradiating light on the photoconductor drum 31 based on image data. The developing device 34 develops, by using toner, the electrostatic latent image formed on the surface of the photoconductor drum 31.

The transfer portion 35 transfers a toner image formed on the surface of the photoconductor drum 31, to a transferred member such as a sheet. As one example, the transfer portion 35 includes a roller-like transferring member. A voltage is applied to the transfer portion 35 from a power supply device (not illustrated). This causes the toner image formed on the surface of the photoconductor drum 31 to be transferred to a sheet.

The cleaning portion 36 cleans the surface of the photoconductor drum 31. Specifically, as shown in FIG. 1, the cleaning portion 36 includes a cleaning blade 361, a cleaning roller 362, and a conveyance spiral 363.

The cleaning blade 361 removes toner adhered to the surface of the photoconductor drum 31. As one example, the cleaning blade 361 is a rubber blade formed in the shape of a blade from urethane rubber, and is provided in contact with the surface of the photoconductor drum 31. The conveyance spiral 363 conveys the toner removed by the cleaning blade 361 to a collection container (not illustrated). The conveyance spiral 363 is, for example, a conveyance screw.

The cleaning roller 362 polishes the surface of the photoconductor drum 31. Specifically, in the image forming apparatus 10, toner has an externally added abrasive such as titanium oxide. The cleaning roller 362 polishes the surface of the photoconductor drum 31 in a state where the toner removed by the cleaning blade 361 is adhered to the surface of the cleaning roller 362. This polishing removes foreign substances such as discharge products that have been generated by a discharge between the photoconductor drum 31 and the charging device 32 and adhered to the surface of the photoconductor drum 31. The surface of the cleaning roller 362 is made of, for example, foamed rubber such as conductive foamed EPDM so that the toner can easily adhere thereto.

The fixing device 37 fuses and fixes a toner image that has been transferred to a sheet by the transfer portion 35, to the sheet. As one example, the fixing device 37 includes a fixing roller 371 and a pressure roller 372. The fixing roller 371 is provided in contact with the pressure roller 372, and fixes a toner image that has been transferred to a sheet, to the sheet by heating. The pressure roller 372 gives a pressure to the sheet that passes through a contact portion formed between the pressure roller 372 and the fixing roller 371.

To the sheet discharge tray 38, the sheet to which the toner image has been fixed by the fixing device 37 is discharged.

In the image forming portion 3, an image is formed in the procedure provided below, on a sheet supplied from a sheet feed cassette attached to the sheet feed portion 4 in a detachable manner, and the sheet with the image formed thereon is discharged to the sheet discharge tray 38. It is noted that the sheet is a sheet-like material such as a sheet of paper, a sheet of coated paper, a postcard, an envelope, or an OHP sheet.

First, the charging device 32 charges the surface of the photoconductor drum 31 uniformly into a certain potential. Next, the optical scanning device 33 irradiates light on the surface of the photoconductor drum 31 based on the image data. This results in an electrostatic latent image formed on the surface of the photoconductor drum 31. The developing device 34 then develops (visualizes) the electrostatic latent image on the photoconductor drum 31 as a toner image. It is noted that toner (developer) is supplied from a toner container 34A attached to the image forming portion 3 in a detachable manner.

Subsequently, the toner image formed on the photoconductor drum 31 is transferred to a sheet by the transfer portion 35. The sheet is then passed through between the fixing roller 371 and the pressure roller 372 of the fixing device 37 while heated by the fixing roller 371. This allows the toner image transferred to the sheet to be fused and fixed to the sheet. It is noted that the toner that has remained on the surface of the photoconductor drum 31 is removed by the cleaning portion 36.

As shown in FIG. 2, the image forming portion 3 includes a motor 31A, a speed detecting portion 31B, a motor driving portion 31C, and a moving mechanism 35A.

The motor 31A rotates the photoconductor drum 31. As one example, in the image forming apparatus 10, a brushless motor is used as the motor 31A.

The speed detecting portion 31B detects a rotation speed of the motor 31A. For example, the speed detecting portion 31B is a rotary encoder attached to a rotation shaft of the motor 31A. The speed detecting portion 31B outputs, to the motor driving portion 31C or the control portion 5, an electric signal having a frequency corresponding to the rotation speed of the motor 31A.

The motor driving portion 31C is a driving circuit that drives the motor 31A by applying a driving voltage to the motor 31A. Specifically, the motor driving portion 31C rotates the motor 31A at a constant speed based on the control signal input from the control portion 5. For example, the motor driving portion 31C controls the rotation speed of the motor 31A by controlling the driving voltage based on the electric signal output from the speed detecting portion 31B. In addition, upon determining, based on the electric signal output from the speed detecting portion 31B, that the rotation speed of the motor 31A has reached a speed specified by the control portion 5, the motor driving portion 31C notifies the control portion 5 of the fact. Here, the motor driving portion 31C is an example of the voltage applying portion of the present disclosure.

The moving mechanism 35A moves the transfer portion 35 between a first position P1 (see FIG. 1) and a second position P2, wherein the transfer portion 35 is in contact with the photoconductor drum 31 at the first position P1, and is separated from the photoconductor drum 31 at the second position P2. As one example, the moving mechanism 35A moves the transfer portion 35 between the first position P1 and the second position P2 by moving the position of a bearing (not illustrated) that rotatably supports a rotation shaft of the transfer portion 35.

Meanwhile, in the image forming apparatus 10, the amount of foreign substances adhered to the surface of the photoconductor drum 31 may increase. When the amount of foreign substances adhered to the surface of the photoconductor drum 31 increases, the load of the motor 31A that rotates the photoconductor drum 31 may become large, and the quality of the image formed may be reduced. With regard to this problem, the following measures may be considered. That is, the load of the motor 31A may be detected based on the current that flows in the motor 31A, and based on the detection result, a cleaning time of the cleaning portion 36 or whether or not to cause the cleaning portion 36 to perform a cleaning may be controlled. In that case, however, a configuration for detecting the current is required. On the other hand, as described below, the image forming apparatus 10 can control, with a simple configuration, the cleaning time of the cleaning portion 36 or whether or not to cause the cleaning portion 36 to perform a cleaning.

Specifically, a first cleaning control program is stored in advance in the ROM of the control portion 5, wherein the first determination program causes the CPU to execute a first obtainment process (see the flowchart of FIG. 3) and a first cleaning control process (see the flowchart of FIG. 4) that are described below. It is noted that the first cleaning control program may be recorded on a non-transitory computer-readable recording medium such as a CD, a DVD, or a flash memory, and may be installed from the recording medium to a storage portion such as the EEPROM of the control portion 5.

As shown in FIG. 2, the control portion 5 includes a measurement processing portion 51, a movement processing portion 52, a cleaning control portion 53, and a notification processing portion 54. Specifically, the control portion 5 executes, with use of the CPU, the first cleaning control program stored in the ROM. This allows the control portion 5 to function as the measurement processing portion 51, the movement processing portion 52, the cleaning control portion 53, and the notification processing portion 54. Here, a device including the photoconductor drum 31, the motor 31A, the cleaning portion 36, and the control portion 5 is an example of the image forming unit of the present disclosure.

The measurement processing portion 51 measures a transition time that is a time required for the motor 31A to transition from a stationary state to a driving state in which the motor 31A rotates at a predetermined speed. Specifically, the measurement processing portion 51 measures the transition time at a first timing and a second timing, wherein the second timing is later than the first timing. Hereinafter, a transition time measured at the first timing is referred to as a first transition time; and a transition time measured at the second timing is referred to as a second transition time.

An example of the first timing is when the image forming apparatus 10 is initialized, or when an execution operation for the first obtainment process is performed on the operation/display portion 6, wherein the first obtainment process is described below. The execution operation is performed, for example, by a person in charge of production, a person in charge of the maintenance work, or a user when the image forming apparatus 10 is shipped or when a maintenance of the image forming portion 3 is performed. The second timing is, for example, each time the image forming apparatus 10 is powered on, or each time the apparatus is returned from a sleep state during which predetermined functions are stopped, during use by the user after the shipment of the image forming apparatus 10 or after the maintenance of the image forming portion 3.

As one example, the measurement processing portion 51 inputs a control signal to the motor driving portion 31C so as to cause the motor driving portion 31C to rotate the motor 31A at the predetermined speed. The measurement processing portion 51 obtains the first transition time or the second transition time by measuring the time that has elapsed from the time when the control signal was input to the motor driving portion 31C, to the time when the notification that the rotation speed of the motor 31A has reached the predetermined speed is sent from the motor driving portion 31C. It is noted that the measurement processing portion 51 may determine whether or not the rotation speed of the motor 31A has reached the predetermined speed, based on the electric signal input from the speed detecting portion 31B instead of the motor driving portion 31C.

The measurement processing portion 51 causes the motor driving portion 31C to apply a constant voltage having a predetermined voltage value that corresponds to the predetermined speed, to the motor 31A so as to rotate the motor 31A. With this configuration, compared to the feedback control in which the motor driving portion 31C adjusts the driving voltage based on the results of a comparison between the predetermined speed and the rotation speed of the motor 31A indicated by the electric signal input from the speed detecting portion 31B, it is possible to reflect, more prominently on the transition time, an increase of the load of the motor 31A caused by the adhered foreign substances. It is noted that the control of the driving voltage by the motor driving portion 31C may be different from the above-described one.

In addition, the predetermined speed is higher than a rotation speed during image formation of the motor 31A. With this configuration, compared to a configuration for measuring a time required for the motor 31A to transition from the stationary state to a driving state in which the motor 31A rotates at the rotation speed during image formation, each of the first transition time and the second transition time is longer than the time measured in that configuration. It is thus possible to reflect, more prominently on the transition time, an increase of the load of the motor 31A caused by the adhered foreign substances.

The movement processing portion 52 moves the transfer portion 35 from the first position P1 to the second position P2. Specifically, when the transfer portion 35 is located at the first position P1 at the first timing or the second timing, the movement processing portion 52 controls the moving mechanism 35A to move the transfer portion 35 from the first position P1 to the second position P2 before the measurement processing portion 51 measures the transition time. As one example, at the first timing and the second timing, the movement processing portion 52 determines whether or not the transfer portion 35 is located at the first position P1 by using a sensor (not illustrated) for detecting the presence or absence of the transfer portion 35 at the first position P1.

The cleaning control portion 53 controls, based on the transition time measured by the measurement processing portion 51, the cleaning time of the cleaning portion 36 or whether or not to cause the cleaning portion 36 to perform a cleaning.

Specifically, the cleaning control portion 53 controls the cleaning time of the cleaning portion 36 or whether or not to cause the cleaning portion 36 to perform a cleaning, based on a difference between the first transition time and the second transition time. For example, when the difference between the first transition time and the second transition time exceeds a first threshold that is obtained by multiplying the first transition time by a preset permissable increasing rate, the cleaning control portion 53 executes a cleaning process for cleaning the surface of the photoconductor drum 31 by using the cleaning portion 36. The permissable increasing rate is set to, for example, 20 percent.

As one example, in the cleaning process, the cleaning control portion 53 rotates the photoconductor drum 31, and rotates the cleaning roller 362 in the same direction as the photoconductor drum 31. In addition, the cleaning control portion 53 supplies toner to the surface of the photoconductor drum 31 by controlling the developing device 34 and the like. This allows the cleaning roller 362 to polish the surface of the photoconductor drum 31. It is noted that the cleaning control portion 53 may rotate the cleaning roller 362 in a reverse direction to the rotation direction of the photoconductor drum 31, at a speed that is different from the rotation speed of the photoconductor drum 31.

It is noted that, when the difference between the first transition time and the second transition time exceeds the first threshold, the cleaning control portion 53 may extend, by a predetermined time, the cleaning time of the cleaning portion 36 during an execution of the print process. In addition, the cleaning control portion 53 may extend the cleaning time of the cleaning portion 36 based on the difference between the first transition time and the second transition time. Furthermore, the cleaning control portion 53 may set the execution time of the cleaning process based on the difference between the first transition time and the second transition time.

In addition, the cleaning control portion 53 may control the cleaning time of the cleaning portion 36 or whether or not to cause the cleaning portion 36 to perform a cleaning, based on only the second transition time. For example, the cleaning control portion 53 may cause the cleaning portion 36 to execute the cleaning process when the second transition time exceeds a preset upper limit time. The upper limit time is set, for example, based on an average value of a plurality of measured values of the first transition time measured by motors 31A mounted in a plurality of image forming apparatuses 10.

The notification processing portion 54 notifies that a maintenance is required when the difference between the first transition time and the second transition time exceeds a predetermined second threshold. Here, the second threshold is an example of the preset threshold of the present disclosure.

As one example, the notification processing portion 54 notifies that a maintenance is required by displaying a message on the operation/display portion 6, the message stating that the photoconductor drum 31 needs to be replaced. It is noted that the second threshold may be set to be larger than the first threshold.

It is noted that the notification processing portion 54 may transmit an electronic mail including the message to a predetermined destination such as a person in charge of the maintenance work of the image forming apparatus 10, in place of or together with displaying the message on the operation/display portion 6. In addition, the electronic mail may include measurement history information that indicates the first transition time and measured values of the second transition time measured at each second timing.

[First Obtainment Process]

Figure 3:
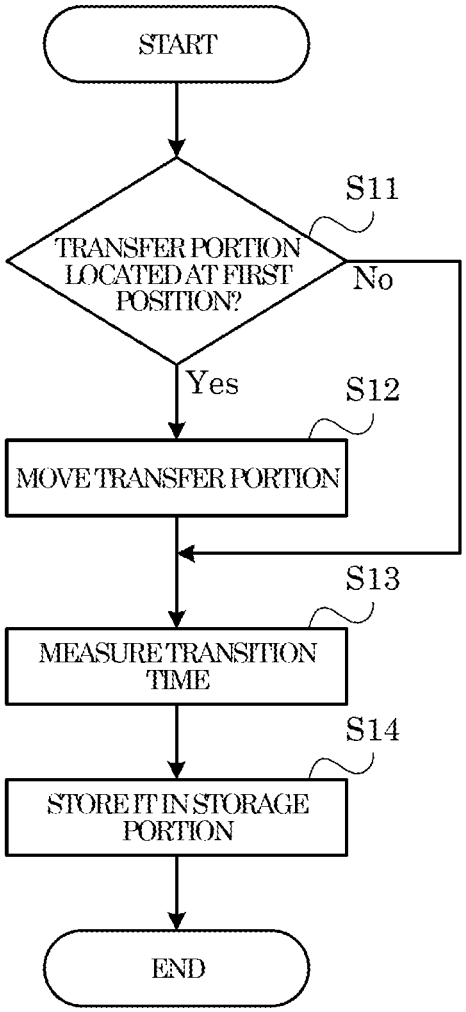
FIG. 3 is a flowchart showing an example of a first obtainment process executed by the image forming apparatus according to the first embodiment of the present disclosure.

In the following, with reference to FIG. 3, a description is given of an example of the procedure of the first obtainment process executed by the control portion 5 in the image forming apparatus 10. Here, steps S11, S12, . . . represent numbers assigned to the processing procedures (steps) executed by the control portion 5. It is noted that the first obtainment process is executed when the first timing comes.

<Step S11>

First, in step S11, the control portion 5 determines whether or not the transfer portion 35 is located at the first position P1. As one example, the control portion 5 uses the sensor to determine whether or not the transfer portion 35 is located at the first position P1.

Upon determining that the transfer portion 35 is located at the first position P1 (Yes side at S11), the control portion 5 moves the process to step S12. On the other hand, upon determining that the transfer portion 35 is not located at the first position P1 (No side at S11), the control portion 5 moves the process to step S13.

<Step S12>

In step S12, the control portion 5 controls the moving mechanism 35A to move the transfer portion 35 from the first position P1 to the second position P2. This prevents the transition time to be measured in step S13 from being affected by a load that may be generated when the transfer portion 35 contacts the photoconductor drum 31. Here, the processes of step S11 and step S12 are executed by the movement processing portion 52 of the control portion 5.

<Step S13>

In step S13, the control portion 5 measures the transition time (the first transition time). Here, the process of step S13 is executed by the measurement processing portion 51 of the control portion 5.

Specifically, the control portion 5 inputs a control signal to the motor driving portion 31C so as to cause the motor driving portion 31C to rotate the motor 31A at the predetermined speed. The control portion 5 then obtains the transition time by measuring the time that has elapsed from the time when the control signal was input to the motor driving portion 31C, to the time when the notification that the rotation speed of the motor 31A has reached the predetermined speed is sent.

<Step S14>

In step S14, the control portion 5 stores, in a storage portion such as the EEPROM, the transition time measured in step S13.

[First Cleaning Control Process]

Figure 4:
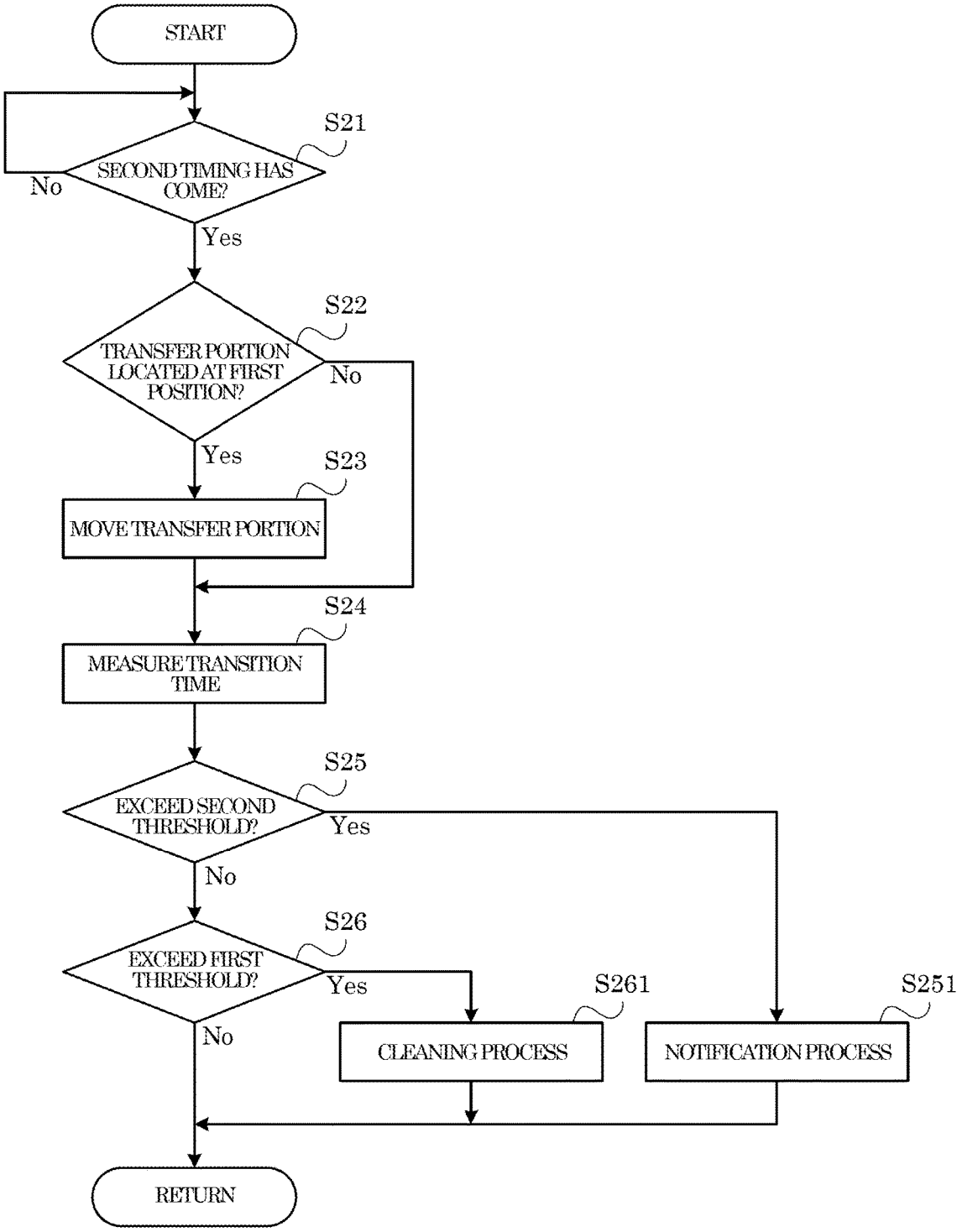
FIG. 4 is a flowchart showing an example of a first cleaning control process executed by the image forming apparatus according to the first embodiment of the present disclosure.

Next, with reference to FIG. 4, a description is given of an example of the procedure of the first cleaning control process executed by the control portion 5 in the image forming apparatus 10, and the cleaning control method of the present disclosure. It is noted that the first cleaning control process is executed after the first obtainment process is executed.

<Step S21>

First, in step S21, the control portion 5 determines whether or not the second timing has come.

Upon determining that the second timing has come (Yes side at S21), the control portion 5 moves the process to step S22. On the other hand, upon determining that the second timing has not come (No side at S21), the control portion 5 waits at step S21 for the second timing to come.

<Step S22>

In step S22, as in step S11 of the first obtainment process, the control portion 5 determines whether or not the transfer portion 35 is located at the first position P1.

Upon determining that the transfer portion 35 is located at the first position P1 (Yes side at S22), the control portion 5 moves the process to step S23. On the other hand, upon determining that the transfer portion 35 is not located at the first position P1 (No side at S22), the control portion 5 moves the process to step S24.

<Step S23>

In step S23, as in step S12 of the first obtainment process, the control portion 5 controls the moving mechanism 35A to move the transfer portion 35 from the first position P1 to the second position P2. This prevents the transition time to be measured in step S24 from being affected by a load that may be generated when the transfer portion 35 contacts the photoconductor drum 31. Here, the processes of step S22 and step S23 are executed by the movement processing portion 52 of the control portion 5.

<Step S24>

In step S24, as in step S13 of the first obtainment process, the control portion 5 measures the transition time (the second transition time). Here, the process of step S24 is an example of the first step of the present disclosure, and is executed by the measurement processing portion 51 of the control portion 5.

<Step S25>

In step S25, the control portion 5 determines whether or not a difference between the first transition time obtained in the first obtainment process and the second transition time measured in step S24 exceeds the second threshold.

Upon determining that the difference between the first transition time obtained in the first obtainment process and the second transition time measured in step S24 exceeds the second threshold (Yes side at S25), the control portion 5 moves the process to step S251. On the other hand, upon determining that the difference is equal to or lower than the second threshold (No side at S25), the control portion 5 moves the process to step S26.

<Step S251>

In step S251, the control portion 5 notifies that a maintenance is required. Here, the process of step S251 is executed by the notification processing portion 54 of the control portion 5.

The control portion 5 notifies that a maintenance is required, for example, by displaying, on the operation/display portion 6, a message that the photoconductor drum 31 needs to be replaced. This makes it possible for the user to make a contact with a person in charge of the maintenance work or the like and have a maintenance service for the image forming portion 3.

In addition, the control portion 5 may transmit an electronic mail including the message to a predetermined destination such as a person in charge of the maintenance work or the like, in place of or together with displaying the message on the operation/display portion 6. This reduces the trouble of the user to make a contact with the person in charge of the maintenance work or the like.

<Step S26>

In step S26, the control portion 5 determines whether or not the difference between the first transition time obtained in the first obtainment process and the second transition time measured in step S24 exceeds the first threshold.

Upon determining that the difference between the first transition time obtained in the first obtainment process and the second transition time measured in step S24 exceeds the first threshold (Yes side at S26), the control portion 5 moves the process to step S261. On the other hand, upon determining that the difference is equal to or lower than the first threshold (No side at S26), the control portion 5 moves the process to step S21.

<Step S261>

In step S261, the control portion 5 causes the cleaning portion 36 to execute the cleaning process. Here, the process of step S261 is an example of the second step of the present disclosure, and is executed by the cleaning control portion 53 of the control portion 5.

As described above, in the first cleaning control process, the transition time, namely, a time required for the motor 31A to transition from the stationary state to a driving state in which the motor 31A rotates at the predetermined speed, is measured, and whether or not to execute the cleaning process is controlled based on the measured transition time. This configuration makes it possible to control, with a simple configuration, whether or not to cause the cleaning portion 36 to execute the cleaning process.

In addition, in the image forming apparatus 10, the first obtainment process is executed and the first transition time is obtained before the first cleaning control process is executed. In the first cleaning control process, whether or not to execute the cleaning process is controlled based on a difference between the first transition time and the second transition time. Compared to a configuration where whether or not to execute the cleaning process is controlled based on a comparison result between the upper limit time and the second transition time, this makes it possible to perform a control in correspondence with a variation in property of each of the motor 31A. This accordingly improves the accuracy of determining whether or not a maintenance is required.

Second Embodiment

In the following, a second embodiment of the present disclosure is described. In the second embodiment, the configuration of the control portion 5 of the image forming apparatus 10 has been partially changed from that in the first embodiment. Specifically, in the image forming apparatus 10 according to the second embodiment, the measurement processing portion 51 of the control portion 5 differs in configuration from that in the first embodiment. It is noted that the rest of the configuration is shared by the second embodiment and the first embodiment.

More specifically, in the image forming apparatus 10 of the second embodiment, the measurement processing portion 51 measures a transition time that is a time required for the motor 31A to transition from a driving state in which the motor 31A rotates at a predetermined first speed, to a driving state in which the motor 31A rotates at a second speed that is lower than the first speed. The measurement processing portion 51 measures the transition time at a third timing and a fourth timing, wherein the fourth timing is later than the third timing. Hereinafter, a transition time measured at the third timing is referred to as a third transition time; and a transition time measured at the fourth timing is referred to as a fourth transition time.

An example of the third timing is when the image forming apparatus 10 is initialized, or when an execution operation of the second obtainment process, which is described below, is performed on the operation/display portion 6. The execution operation is performed, for example, by a person in charge of production, a person in charge of the maintenance work, or a user when the image forming apparatus 10 is shipped or when a maintenance of the image forming portion 3 is performed. An example of the fourth timing is, for example, when an execution of a predetermined number of print processes is completed.

Here, the first speed is the same as the rotation speed during image formation of the motor 31A. This makes it possible to measure the fourth transition time by using a rotation state of the motor 31A immediately after the execution of the print processes. It is noted that the first speed may be the same as the predetermined speed.

As one example, the measurement processing portion 51, at the third timing, inputs a control signal to the motor driving portion 31C so as to cause the motor driving portion 31C to rotate the motor 31A at the first speed. The measurement processing portion 51 then inputs a control signal to the motor driving portion 31C so as to cause the motor driving portion 31C to change the rotation speed of the motor 31A to the second speed. The measurement processing portion 51 then obtains the third transition time by measuring the time that has elapsed from the time when the control signal instructing to change the rotation speed was input to the motor driving portion 31C, to the time when the notification that the rotation speed of the motor 31A has reached the second speed is sent. It is noted that the measurement processing portion 51 may determine whether or not the rotation speed of the motor 31A has reached the second speed, based on the electric signal input from the speed detecting portion 31B instead of the motor driving portion 31C.

On the other hand, the measurement processing portion 51, at the fourth timing, inputs a control signal to the motor driving portion 31C so as to cause the motor driving portion 31C to change the rotation speed of the motor 31A to the second speed. The measurement processing portion 51 then obtains the fourth transition time by measuring the time that has elapsed from the time when the control signal instructing to change the rotation speed was input to the motor driving portion 31C, to the time when the notification that the rotation speed of the motor 31A has reached the second speed is sent from the motor driving portion 31C.

It is noted that the measurement processing portion 51 causes the motor driving portion 31C to change the rotation speed of the motor 31A by causing the motor driving portion 31C to stop applying the driving voltage to the motor 31A. With this configuration, compared to the feedback control in which the motor driving portion 31C adjusts the driving voltage based on a result of a comparison between the second speed and a rotation speed of the motor 31A indicated by the electric signal input from the speed detecting portion 31B, it is possible to reflect, more prominently on the transition time, an increase of the load of the motor 31A caused by the adhered foreign substances. It is noted that the control of the driving voltage by the motor driving portion 31C may be different from the above-described one.

[Second Obtainment Process]

Figure 5:
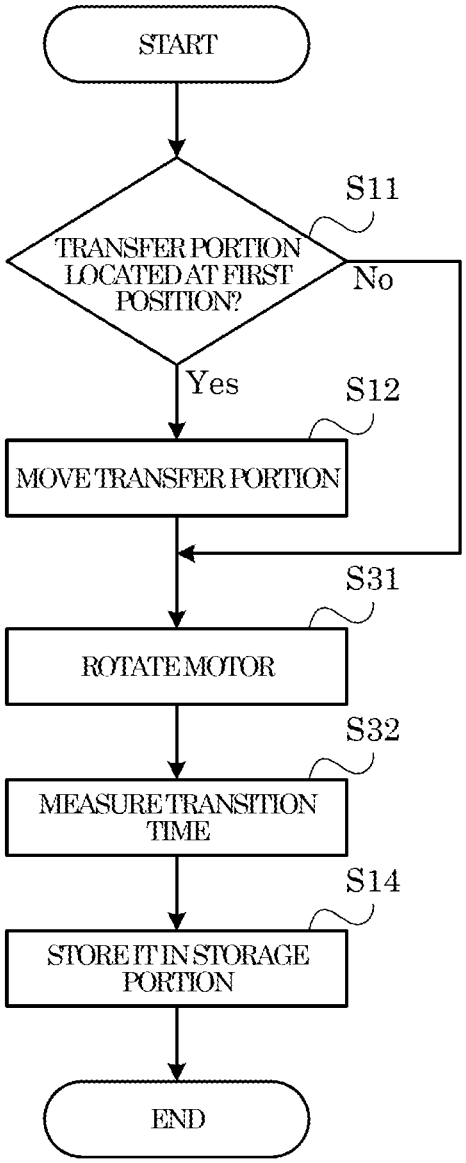
FIG. 5 is a flowchart showing an example of a second obtainment process executed by an image forming apparatus according to a second embodiment of the present disclosure.

In the following, with reference to FIG. 5, a description is given of an example of the procedure of the second obtainment process executed by the control portion 5 in the image forming apparatus 10 according to the second embodiment. The second obtainment process is executed when the third timing comes. It is noted that, in the second obtainment process, the processes that are the same as those of the first obtainment process are assigned the same reference signs, and description thereof is omitted.

<Step S31>

First, in step S31, the control portion 5 inputs a control signal to the motor driving portion 31C and causes the motor driving portion 31C to rotate the motor 31A at the first speed. Here, the process of step S31 is executed by the measurement processing portion 51 of the control portion 5.

<Step S32>

In step S32, the control portion 5 measures the transition time (the third transition time). Here, the process of step S32 is executed by the measurement processing portion 51 of the control portion 5.

Specifically, the control portion 5 inputs a control signal to the motor driving portion 31C and causes the motor driving portion 31C to change the rotation speed of the motor 31A to the second speed. The control portion 5 then obtains the transition time by measuring the time that has elapsed from the time when the control signal instructing to change the rotation speed was input to the motor driving portion 31C, to the time when the notification that the rotation speed of the motor 31A has reached the second speed is sent from the motor driving portion 31C.

[Second Cleaning Control Process]

Figure 6:
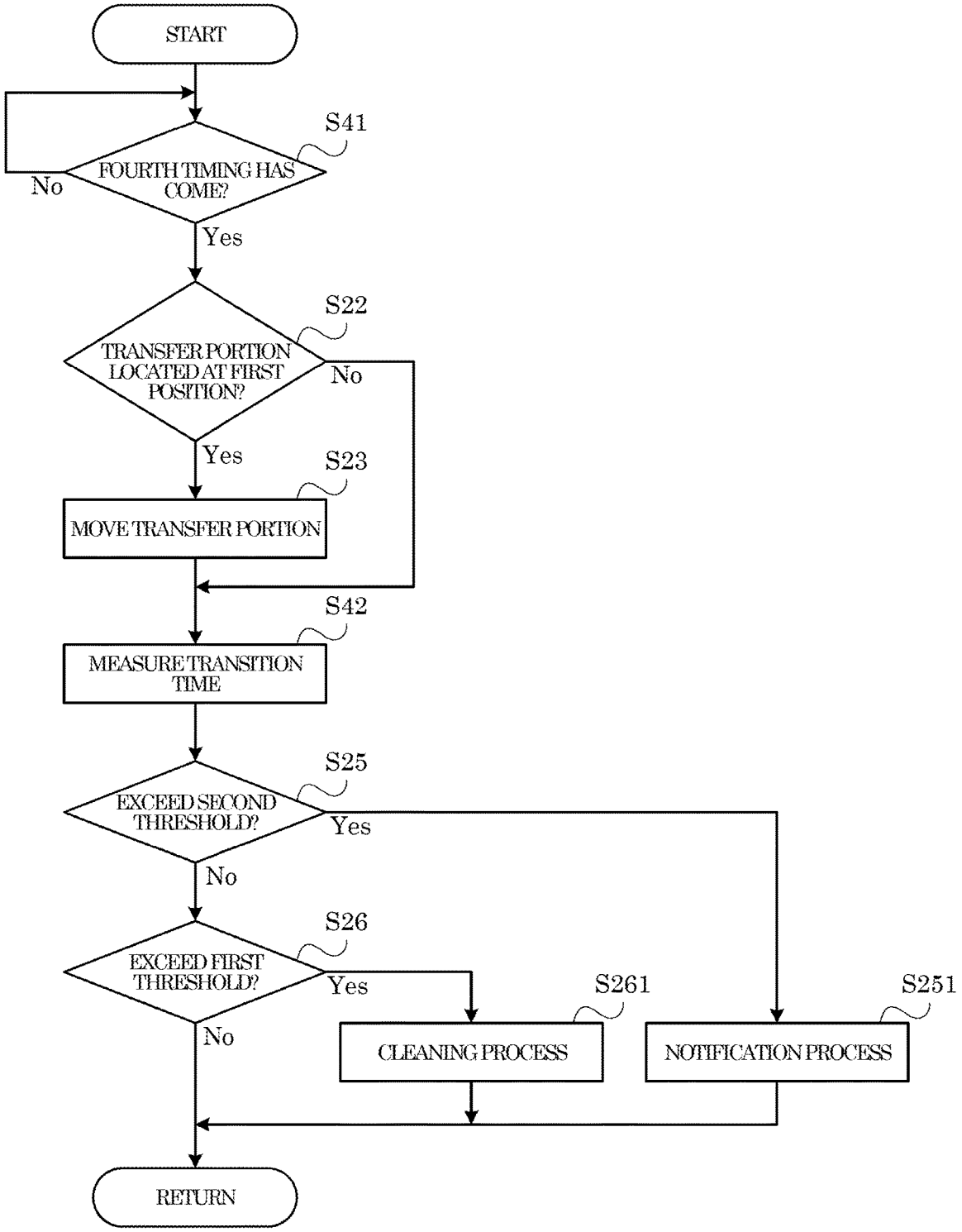
FIG. 6 is a flowchart showing an example of a second cleaning control process executed by the image forming apparatus according to the second embodiment of the present disclosure.

Next, with reference to FIG. 6, a description is given of an example of the procedure of the second cleaning control process executed by the control portion 5 in the image forming apparatus 10 according to the second embodiment, and the cleaning control method of the present disclosure. It is noted that the second cleaning control process is executed after the second obtainment process is executed. It is noted that, in the second cleaning control process, the processes that are the same as those of the first cleaning control process are assigned the same reference signs, and description thereof is omitted.

<Step S41>

First, in step S41, the control portion 5 determines whether or not the fourth timing has come.

Upon determining that the fourth timing has come (Yes side at S41), the control portion 5 moves the process to step S22. On the other hand, upon determining that the fourth timing has not come (No side at S41), the control portion 5 waits at step S41 for the fourth timing to come.

<Step S42>

In step S42, as in step S32 of the second obtainment process, the control portion 5 measures the transition time (the fourth transition time). Here, the process of step S42 is executed by the measurement processing portion 51 of the control portion 5.

As described above, in the second cleaning control process, the transition time that is a time required for the motor 31A to transition from a driving state in which the motor 31A rotates at the first speed to a driving state in which the motor 31A rotates at the second speed, is measured, and whether or not to execute the cleaning process is controlled based on the measured transition time. Accordingly, as is the case with the image forming apparatus 10 according to the first embodiment, it is possible to control, with a simple configuration, whether or not to cause the cleaning portion 36 to execute the cleaning process.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image carrier configured to carry an electrostatic latent image;

a motor configured to rotate the image carrier;

a cleaning portion configured to clean the image carrier;

a measurement processing portion configured to measure a transition time that is a time required for the motor to transition from a stationary state to a driving state in which the motor rotates at a predetermined speed, wherein the measurement processing portion measures the transition time at a predetermined first timing and at a second timing that is later than the first timing; and a cleaning control portion configured to control a cleaning time of the cleaning portion or whether or not to cause the cleaning portion to clean the image carrier, based on a difference between a transition time measured at the first timing and a transition time measured at the second timing.

2. The image forming apparatus according to claim 1, further comprising a notification processing portion configured to notify that a maintenance is required, when the difference between the transition time measured at the first timing and the transition time measured at the second timing exceeds a predetermined threshold.

3. An image forming apparatus comprising:

an image carrier configured to carry an electrostatic latent image;

a motor configured to rotate the image carrier;

a cleaning portion configured to clean the image carrier;

a measurement processing portion configured to measure a transition time that is a time required for the motor to transition from a stationary state to a driving state in which the motor rotates at a predetermined speed;

a cleaning control portion configured to control a cleaning time of the cleaning portion or whether or not to cause the cleaning portion to clean the image carrier;

a transfer portion provided so as to be movable between a first position and a second position, and configured to transfer a toner image carried on the image carrier to a transferred member, the transfer portion being in contact with the image carrier at the first position, and being separated from the image carrier at the second position; and a movement processing portion configured to move the transfer portion from the first position to the second position when the measurement processing portion measures the transition time.

4. An image forming apparatus comprising:

an image carrier configured to carry an electrostatic latent image;

a motor configured to rotate the image carrier;

a cleaning portion configured to clean the image carrier;

a measurement processing portion configured to measure a transition time that is a time required for the motor to transition from a stationary state to a driving state in which the motor rotates at a predetermined speed, wherein the predetermined speed is higher than a rotation speed of the motor during an image formation; and a cleaning control portion configured to control a cleaning time of the cleaning portion or whether or not to cause the cleaning portion to clean the image carrier.

* * * * *